US007696136B2

(12) United States Patent
Migdal et al.

(10) Patent No.: US 7,696,136 B2
(45) Date of Patent: Apr. 13, 2010

(54) LUBRICANT COMPOSITIONS CONTAINING HYDROXY CARBOXYLIC ACID AND HYDROXY POLYCARBOXYLIC ACID ESTERS

(75) Inventors: Cyril A. Migdal, Pleasant Valley, NY (US); Robert G. Rowland, Woodbridge, CT (US)

(73) Assignee: Crompton Corporation, Middlebury, CT (US)

( * ) Notice: Subject to any disclaimer, the term of this patent is extended or adjusted under 35 U.S.C. 154(b) by 953 days.

(21) Appl. No.: 10/979,529

(22) Filed: Nov. 1, 2004

(65) Prior Publication Data

US 2005/0198894 A1 Sep. 15, 2005

Related U.S. Application Data

(60) Provisional application No. 60/551,827, filed on Mar. 11, 2004.

(51) Int. Cl.

| | |
|---|---|
| ***C10L 1/22*** | (2006.01) |
| ***C10L 10/18*** | (2006.01) |
| ***C10M 105/34*** | (2006.01) |
| ***C10M 159/22*** | (2006.01) |
| ***C07C 69/34*** | (2006.01) |
| ***C07C 65/17*** | (2006.01) |
| ***C10L 1/18*** | (2006.01) |

(52) U.S. Cl. ..... 508/367; 508/463; 508/465; 508/478; 508/479; 44/388

(58) Field of Classification Search ..... 508/465, 508/478, 371, 367, 463, 479
See application file for complete search history.

(56) References Cited

U.S. PATENT DOCUMENTS

| | | | | |
|---|---|---|---|---|
| 2,796,400 | A * | 6/1957 | Thornley | 508/246 |
| 3,293,181 | A | 12/1966 | Stuart | 252/32.7 |
| 3,396,109 | A | 8/1968 | Butler | 252/32.7 |
| 3,397,145 | A | 8/1968 | Cyba | 252/32.7 |
| 3,442,804 | A | 5/1969 | Le Suer | 252/32.7 |
| 3,637,499 | A | 1/1972 | Pollak | 252/32.7 |
| 4,028,065 | A | 6/1977 | Sprague et al. | |
| 4,151,102 | A | 4/1979 | Baur | 252/56 |
| 4,175,047 | A * | 11/1979 | Schick et al. | 508/485 |
| 4,741,848 | A | 5/1988 | Koch et al. | |
| 5,069,684 | A | 12/1991 | Blain et al. | |
| 5,084,195 | A | 1/1992 | Camenzind et al. | 252/47.5 |
| 5,089,658 | A | 2/1992 | Elmore et al. | |
| 5,194,068 | A | 3/1993 | Mohr et al. | |
| 5,230,730 | A | 7/1993 | Speckmann et al. | |
| 5,296,003 | A | 3/1994 | Cherpeck | |
| 5,300,243 | A | 4/1994 | Camenzind et al. | 252/47.5 |
| 5,338,470 | A | 8/1994 | Hiebert et al. | 252/51.5 |
| 5,498,809 | A | 3/1996 | Emert et al. | 585/13 |
| 5,512,190 | A | 4/1996 | Anderson et al. | 252/47 |
| 5,514,189 | A | 5/1996 | Farng et al. | 44/383 |
| 5,614,268 | A | 3/1997 | Varley et al. | |
| 5,726,130 | A | 3/1998 | Yamanaka | |
| 5,731,274 | A | 3/1998 | Andrew | |
| 5,780,399 | A | 7/1998 | Ishikawa et al. | |
| 5,827,334 | A | 10/1998 | Cherpeck | |
| 5,965,495 | A * | 10/1999 | Goto et al. | 508/192 |
| 5,976,414 | A | 11/1999 | Bedford et al. | |
| 6,001,141 | A | 12/1999 | Quigley | |
| 6,008,169 | A | 12/1999 | Kaneko | |
| 6,174,426 | B1 | 1/2001 | Osanaiye | |
| 6,458,173 | B1 | 10/2002 | Lin | |
| 6,498,130 | B2 | 12/2002 | Baum et al. | |
| 6,551,966 | B2 | 4/2003 | Nalesnik | 508/277 |
| 6,719,815 | B2 | 4/2004 | Nanniga et al. | |

FOREIGN PATENT DOCUMENTS

| | | |
|---|---|---|
| CS | 254033 | 12/1987 |
| EP | 0251192 | 1/1988 |
| EP | 0200001 B1 | 5/1989 |
| EP | 562405 | 3/1993 |
| EP | 0562405 | 9/1993 |
| EP | 0661376 | 7/1995 |
| EP | 0773278 | 5/1997 |
| EP | 0773279 | 5/1997 |
| EP | 0859040 | 8/1998 |
| FR | 2205931 | 5/1974 |
| JP | 01022336 | 1/1989 |
| JP | 7-268369 | 10/1995 |
| JP | 07268369 | 10/1995 |
| JP | 11228977 | 8/1999 |
| JP | 11299326 | 10/1999 |
| JP | 2002-90669 | 3/2002 |
| WO | 01-060954 | 8/2001 |

OTHER PUBLICATIONS

Mirci L. et al., Synthetic Lubrication (2003), 20(1), 39-52.
Ponomoceoko A.G. et al., Trenie I Iznos (1998), 9(2) 305-310 (CAN 109:233832).

* cited by examiner

*Primary Examiner*—Walter D Griffin
*Assistant Examiner*—Frank C Campanell
(74) *Attorney, Agent, or Firm*—Katten Muchin Rosenman LLP

(57) ABSTRACT

Disclosed herein is a composition comprising:
(A) a lubricant or a hydrocarbon fuel;
(B) at least one hydroxy carboxylic acid ester or hydroxy polycarboxylic acid ester having the generic formula defined herein; and
(C) at least one phosphorus-containing additive.

21 Claims, No Drawings

LUBRICANT COMPOSITIONS CONTAINING HYDROXY CARBOXYLIC ACID AND HYDROXY POLYCARBOXYLIC ACID ESTERS

I claim the benefit under Title 35, United States Code, §120 to U.S. Provisional Application No. 60/551,827, filed Mar. 11, 2004, entitled LUBRICANT AND FUEL COMPOSITIONS CONTAINING HYDROXY POLYCARBOXYLIC ACID ESTERS.

BACKGROUND OF THE INVENTION

1. Field of the Invention

This invention is related to fuels, especially hydrocarbon fuels, and lubricants, especially lubricating oils, and, more particularly, to a lubricant composition containing a class of anti-wear, anti-fatigue, and extreme pressure additives for such fuels and lubricants that are derived from hydroxy carboxylic acid esters and hydroxy polycarboxylic acid esters.

2. Description of Related Art

In developing lubricating oils, there have been many attempts to provide additives that impart anti-fatigue, anti-wear, and extreme pressure properties thereto. Zinc dihydrocarbyldithiophosphates (ZDDP) have been used in formulated oils as anti-wear additives for more than 50 years. However, zinc dihydrocarbyldithiophosphates give rise to ash, which contributes to particulate matter in automotive exhaust emissions, and regulatory agencies are seeking to reduce emissions of zinc into the environment. In addition, phosphorus, also a component of ZDDP, is suspected of limiting the service life of the catalytic converters that are used on cars to reduce pollution. It is important to limit the particulate matter and pollution formed during engine use for toxicological and environmental reasons, but it is also important to maintain undiminished the anti-wear properties of the lubricating oil.

In view of the aforementioned shortcomings of the known zinc and phosphorus-containing additives, efforts have been made to provide lubricating oil additives that contain neither zinc nor phosphorus or, at least, contain them in substantially reduced amounts. Illustrative of non-zinc, i.e., ashless, non-phosphorus-containing lubricating oil additives are the reaction products of 2,5-dimercapto-1,3,4-thiadiazoles and unsaturated mono-, di-, and tri-glycerides disclosed in U.S. Pat. No. 5,512,190 and the dialkyl dithiocarbamate-derived organic ethers of U.S. Pat. No. 5,514,189.

U.S. Pat. No. 5,512,190 discloses an additive that provides anti-wear properties to a lubricating oil. The additive is the reaction product of 2,5-dimercapto-1,3,4-thiadiazole and a mixture of unsaturated mono-, di-, and triglycerides. Also disclosed is a lubricating oil additive with anti-wear properties produced by reacting a mixture of unsaturated mono-, di-, and triglycerides with diethanolamine to provide an intermediate reaction product and reacting the intermediate reaction product with 2,5-dimercapto-1,3,4 thiadiazole.

U.S. Pat. No. 5,514,189 discloses that dialkyl dithiocarbamate-derived organic ethers have been found to be effective anti-wear/antioxidant additives for lubricants and fuels.

U.S. Pat. No. 3,293,181 discloses that zinc dialkyl dithiophosphates of improved thermal stability can be provided by the zinc salts of mixed dialkyl dithiophosphoric acids in which the alkyl groups are derived from a mixture of at least two different branched chain primary alcohols, one of the alcohols being isobutyl alcohol and the other containing at least six carbon atoms.

U.S. Pat. No. 3,396,109 discloses the preparation of phosphorus- and nitrogen-containing compositions by reacting a metal salt of a phosphinodithioic acid, especially a zinc salt of a diarylphosphinodithioic acid, with an amine, especially an aliphatic amine having from one to about forty carbon atoms. The compositions are said to be useful as additives for lubricating oils and automatic transmission fluids, in which they act as oxidation inhibitors and anti-wear agents. They are also said to afford synergistic oxidation inhibition properties when used with phenyl β-naphthyl amines.

U.S. Pat. No. 3,397,145 discloses an alkylthiophosphoric acid salt formed by the addition reaction thereof to a tertiary nitrogen atom of a condensation product containing said tertiary atom and comprising a polymeric reaction product.

U.S. Pat. No. 3,442,804 discloses a lubricating composition containing a small amount of a particularly defined zinc phosphorodithioate. The zinc phosphorodithioate is illustrated by that derived from dihydrocarbon phosphorodithioic acid in which the hydrocarbon radicals are primary alkyl radicals and consist of a mixture of lower molecular weight radicals (i.e., having less than 5 carbon atoms) and higher molecular weight radicals (i.e., having at least 5 carbon atoms). In the particularly defined zinc phosphorodithioate, the ratio of the lower molecular weight radicals to the higher molecular weight radicals, expressed on a molar basis, is with the range of 1:1 to 3:1.

U.S. Pat. No. 3,637,499 discloses lubricating oil compositions containing as anti-wear and detergent-inhibitor additives therein, an amine neutralized derivative of a dithiophosphoric acid prepared by reacting a long chain alkenyl-substituted $C_3$-$C_8$ monocarboxylic acid of 400-3,000 molecular weight with a primary or secondary hydrocarbylol amine, reacting the resultant amide with a phosphorus sulfide and neutralizing the resultant dithiophosphoric acid with a polyamino compound.

U.S. Pat. No. 4,151,102 discloses a synthetic bearing lubricant that prevents wear and is such that when it contaminates the rolling lubricant the rolled product is not stained. The bearing lubricant contains poly-isobutene, at least one ester of a $C_2$ to $C_5$ alcohol with an α-hydroxy-mono carboxylic acid or an α-hydroxy-dicarboxylic acid, and at least single or poly unsaturated $C_{13}$ to $C_{19}$ carboxylic acid.

U.S. Pat. No. 4,741,848 discloses a method of preparing boron-containing compositions that comprises reacting at least one hydroxy-substituted ester, amide or imide with a boron compound. Such boron-containing compositions are said to be useful in fuel compositions and in lubricating oils and to provide the lubricating oils with anti-wear and/or friction-reducing properties.

U.S. Pat. Nos. 5,084,195 and 5,300,243 disclose N-acyl-thiourethane thioureas as anti-wear additives specified for lubricants or hydraulic fluids.

U.S. Pat. No. 5,338,470 discloses alkylated citric acid derivatives obtained as a reaction product of citric acid and an alkyl alcohol or an amine that are said to be effective antiwear and friction modifying additives for fuels and lubricants.

U.S. Pat. No. 5,498,809 discloses oil soluble copolymers derived from ethylene and 1-butene which have a number average molecular weight between about 1,500 and 7,500, at least about 30 percent of all polymer chains terminated with ethylvinylidene groups, and ethylene-derived content of not greater than about 50 weight percent, and which form solutions in mineral oil free of polymer aggregates, as determined by light scattering measurements. Lubricating oil additives, particularly dispersants, produced by the functionalization and derivatization of these copolymers are said to have enhanced performance (e.g., improved dispersancy and pour point) in lubricating oil compositions, attributable in part to the combination of properties characterizing the copolymers.

CS 254033 teaches the use of 2-ethylhexyl-4-hexadecylsalicylic acid as a friction modifier in motor oils.

EP 562405 discloses the use of citrate esters for refrigeration compressor lubricants.

FR 2205931 discloses the use of butyl lactate 33% wt as part of a base stock formulation. 0.7% ZDDP is used.

JP1995268369A discloses additives consisting of hydroxy polycarboxylic ester compounds., e.g., $(R^1—CO_2)_3C—OH$, where $R^1$ is alkyl group of 1-18 carbons. The lubricating oil compounds contain 0.1-40 wt. % of the hydroxy polycarboxylic ester additives. The additives are said to provide abrasion resistance to pure lubricating oils.

JP 2000290669 discloses using an 90-100% of an ester with up to 10% of a nonionic surfactant as an agent for stripping water from fuel oils or gasoline. The preferred esters are methyl a-hydroxyisobutyrate, ethyl a-hydroxyisobutyrate, hexyl a-hydroxyisobutyrate, methyl lactate, octyl lactate, hexyl glycolate, and octyl glycolate.

WO 2001060954 discloses a-hydroxymonocarboxylic esters as diesel fuel additive, preferably at 3-6%.

Mirci, L. et al., *Synthetic Lubrication* (2003), 20(1) 39-52 discusses the use of complex esters based on citric acid as synthetic base stocks.

Ponomorenko, A. G. et al., *Trenie I Iznos* (1998), 9(2) 305-310 (CAN 109:233832) state that the anti-wear and friction properties of individual and tartaric esters are improved when they are diluted with paraffin oil. The ester should not be less than 30-50% of the mixture.

The disclosures of the foregoing references are incorporated herein by reference in their entirety.

SUMMARY OF THE INVENTION

The present invention is directed to a lubricant composition that comprises an additive that can be used either alone or in synergistic combination with (1) zinc dihydrocarbyldithiophosphates, or (2) ashless phosphorus-containing additives, or (3) mixtures of (1) and (2), in order to reduce the amounts of zinc and phosphates that are currently used, without diminishing anti-wear performance. These additives can also be used in combination with other additives typically found in motor oils, as well as other ashless anti-wear additives. The typical additives found in motor oils include dispersants, detergents, anti-wear agents, extreme pressure agents, rust inhibitors, antioxidants, antifoamants, friction modifiers, Viscosity Index (V.I.) improvers, metal passivators, and pour point depressants.

The compounds employed in the practice of this invention are hydroxy carboxylic acid esters and hydroxy polycarboxylic acid esters that are useful as non-phosphorus-containing, anti-fatigue, anti-wear, extreme pressure additives for fuels and lubricating oils.

The present invention provides a lubricating oil composition comprising a lubricating oil and a functional property-improving amount of at least one hydroxy carboxylic acid ester or hydroxy polycarboxylic acid ester either alone or in synergistic combination with a zinc dihydrocarbyldithiophosphate or an ashless phosphorus-containing additive, such as trilauryl phosphate or triphenylphosphorothionate.

As employed herein, the term "hydrocarbyl" includes hydrocarbon as well as substantially hydrocarbon groups. "Substantially hydrocarbon" describes groups that contain heteroatom substituents that do not alter the predominantly hydrocarbon nature of the group. Examples of hydrocarbyl groups include the following:

(1) hydrocarbon substituents, i.e., aliphatic (e.g., alkyl or alkenyl), alicyclic (e.g., cycloalkyl, cycloalkenyl) substituents, aromatic substituents, aromatic-, aliphatic-, and alicyclic-substituted aromatic substituents, and the like, as well as cyclic substituents wherein the ring is completed through another portion of the molecule (that is, for example, any two indicated substituents may together form an alicyclic radical);

(2) substituted hydrocarbon substituents, i.e., those substituents containing non-hydrocarbon groups that, in the context of this invention, do not alter the predominantly hydrocarbon nature of the substituent; those skilled in the art will be aware of such groups (e.g., halo, hydroxy, mercapto, nitro, nitroso, sulfoxy, etc.); and (3) heteroatom substituents, i.e., substituents that will, while having a predominantly hydrocarbon character within the context of this invention, contain an atom other than carbon present in a ring or chain otherwise composed of carbon atoms (e.g., alkoxy or alkylthio). Suitable heteroatoms will be apparent to those of ordinary skill in the art and include, for example, sulfur, oxygen, nitrogen, and such substituents as, e.g., pyridyl, furyl, thienyl, imidazolyl, etc. Preferably, no more than about 2, more preferably no more than one, hetero substituent will be present for every ten carbon atoms in the hydrocarbyl group. More preferably, there will be no such heteroatom substituents in the hydrocarbyl group, i.e., the hydrocarbyl group is purely hydrocarbon.

It is an object of the present invention to provide a new application for hydroxy carboxylic acid esters and hydroxy polycarboxylic acid esters useful either alone or in synergistic combination with ashless phosphorus-containing additives, such as zinc dihydrocarbyl dithiophosphate, that are an improvement over the prior art. Zinc dihydrocarbyldithiophosphate is a general description that includes the following: zinc dialkyldithiophosphate, zinc diaryldithiophosphate, zinc alkylaryldithiophosphate and combinations thereof. It may be used either alone or in combination with other lubricant additives.

Other ashless phosphorus-containing additives that can be employed in the practice of the present invention include, but are not limited to, monohydrocarbyl dihydrogen phosphites, dihydrocarbyl hydrogen phosphites, trihydrocarbyl phosphites, and mixtures thereof, for example, dibutyl phosphite, dihexyl phosphite, dicyclohexyl phosphite, diisodecyl phosphite, di-n-octylphosphite, Irgafos® OPH, diphenyl isodecyl phosphite, diphenyl phosphite, di-n-octyl phosphite, dioleyl hydrogen phosphite, dimethylphenyl phosphite, ethyl hexyl diphenyl phosphite, phenyl diisodecyl phosphite, triisodecyl phosphite, triisoocytyl phosphite, trilauryl phosphite, triphenyl phosphite, tris(dipropyleneglycol)phosphite, tris(nonylphenyl)phosphites, tris(2,4-di-t-butylphenyl)phosphite, tris(5-norbornene-2-methyl)phosphite, tris(tridecyl)phosphite; also di- and tri-phosphites, such as bis(2,4-di-t-butylphenyl)pentaerythritol diphosphite, bis(2,6-di-t-butyl-4-methylphenyl)pentaerythritol diphosphite, bis(2,4-dicumylphenyl)pentaerythritol diphosphite, diisodecyl pentaerythritol diphosphite, distearyl pentaerythritol diphosphites, heptakis(dipropyleneglycol)triphosphite, tetraphenyl dipropyleneglycol diphosphite, tetrakis(2,4-di-t-butylphenyl)-4,4'-biphenylene diphosphite; also poly(dipropyleneglycol)phenyl phosphite, poly 4,4'isopropylidenediphenol-$C_{12}$-$C_{15}$ alcohol phosphite (Weston 439), Alkyl ($C_{10}$) bisphenol A phosphite (Doverphos® 675, Dover), Alkyl ($C_{12}$-$C_{15}$) bisphenol A phosphite (Doverphos 613), tris (dipropyleneglycol)phosphite, phenyl neopentylene glycol phosphite, 2,4,6-tri-t-butylphenyl-2-butyl-2-ethyl-1,3 propanediol phosphite; 2,2-methylenebis(4,6-di-tert-butylphenyl)2-ethylhexyl phosphite, monohydrocarbyl dihydrogen phosphates, dihydrocarbyl hydrogen phosphates, and trihydrocarbyl phosphates, such as tributyl phosphate, triphenyl phosphate, and tritolyl phosphate, dithiophosphates (such as Irgalube® 62 and Irgalube 353), trithiophosphates, trilauryl trithiophosphite; phosphonites, Irgafos 12 (Ciba, CA #[80410-33-9]), diphosphonites, phosphorothionates such as triphenyl phosphorothionate (e.g. Irgalube TPPT), tris(nonylphenyl)phosphorothionate (such as Irgalube 211) and tris (butylphenyl)phosphorothionate (such as Irgalube 232), amine phosphates (such as Irgalube 349).

The lubricant additive composition of the present invention is especially useful as a component in many different lubricating oil compositions. The additive compositions can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in fuels, gas engine lubricants, turbine lubricants, automatic transmission fluids, gear lubricants, compressor lubricants, metal-working lubricants, hydraulic fluids, and other lubricating oil and grease compositions.

The anti-fatigue, anti-wear, and extreme pressure additives of the present invention are hydroxy carboxylic acid esters or hydroxy polycarboxylic acid esters having the following generic formula:

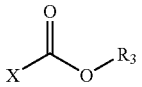

wherein:

$R_3$ is selected from the group consisting of $C_1$-$C_{18}$ linear or branched alkyl $C_1$-$C_{18}$ linear or branched alkenyl, alkoxyalkyl, hydroxyalkyl, aryl, and benzyl; and X— is selected from the group consisting of

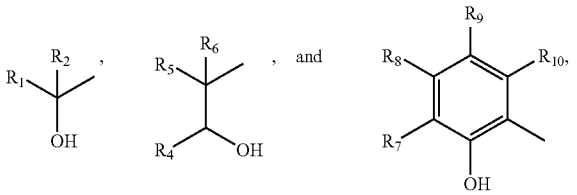

wherein:

$R_1$ is selected from the group consisting of hydrogen, $CH_2CO_2R_3$, $CH(OH)CO_2R_3$, alkyl, aryl, alkoxyalkyl, and alkaryl;

$R_2$ is selected from the group consisting of hydrogen, alkyl, and $CH_2CO_2R_3$; provided that:

if $R_1$ is $CH_2CO_2R_3$, then $R_2$is hydrogen or $CH_2CO_2R_3$;

if $R_1$ is $CH(OH)CO_2R_3$, then $R_2$ is hydrogen;

if $R_1$ is alkyl, aryl, alkoxyalkyl, or alkaryl, then $R_2$ is hydrogen or alkyl;

$R_4$ is selected from the group consisting of hydrogen, alkyl, aryl, and $CH_2CO_2R_3$;

$R_5$ and $R_6$ are independently selected from the group consisting of hydrogen, alkyl, and aryl; and $R_7$, $R_8$, $R_9$, and $R_{10}$ are independently selected from the group consisting of hydrogen, $CO_2R_3$, alkyl, and fused aryl.

In the foregoing, $R_1$, $R_2$, or any of $R_4$ through $R_{10}$ are alkyl or are alkyl substituents, they are preferably alkyl of from 1 to 18 carbon atoms. Aryl moieties will normally be of from 6 to 10 carbon atoms.

More particularly, the present invention is directed to a composition comprising:

(A) a lubricant or a hydrocarbon fuel; and (B) at least one hydroxy carboxylic or hydroxy polycarboxylic acid ester of the formula:

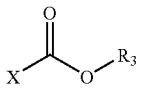

wherein X— and $R_3$ are as described above.

In another embodiment, the present invention is directed to a composition comprising:

(A) a lubricant or a hydrocarbon fuel;

(B) at least one hydroxy carboxylic or hydroxy polycarboxylic acid ester of the formula:

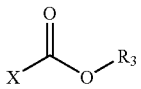

wherein X— and $R_3$ are as described above; and (C) at least one phosphorus-containing additive, preferably a zinc dihydrocarbyldithiophosphate of the formula:

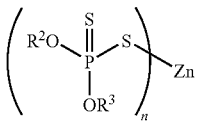

wherein n is 2, $R^2$ and $R^3$ are independently selected hydrocarbyl groups, preferably alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each preferably have, on average, at least 3 carbon atoms.

In still another embodiment, the present invention is directed to a method for improving the anti-fatigue, anti-wear, and extreme pressure properties of lubricants and hydrocarbon fuels comprising adding to said lubricants and hydrocarbon fuels a functional property-improving amount of at least one hydroxy carboxylic acid ester or hydroxy polycarboxylic acid ester of the formula:

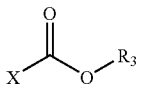

wherein X— and $R_3$ are as described above.

In yet another embodiment, the present invention is directed to a method for improving the anti-fatigue, anti-wear, and extreme pressure properties of lubricants and hydrocarbon fuels comprising adding to said lubricants and hydrocarbon fuels a functional property-improving amount of:

(A) at least one hydroxy carboxylic acid ester or hydroxy polycarboxylic acid ester of the formula:

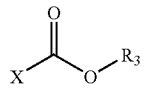

wherein X— and $R_3$ are as described above; and (B) at least one phosphorus-containing additive, preferably a zinc dihydrocarbyldithiophosphate of the formula:

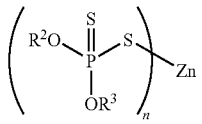

wherein n is 2 and $R^2$ and $R^3$ are independently selected hydrocarbyl groups.

The hydroxy carboxylic acid ester or polycarboxylic acid ester is present in the compositions of the present invention in a concentration in the range of from about 0.01 to about 10 wt %.

The ashless phosphorus-containing additive, if present in the compositions of the present invention, will be in a concentration in the range of from about 0.01 to about 10 wt %, preferably from about 0.1 to about 2.0 wt %.

The combination of hydroxy carboxylic acid ester or polycarboxylic acid ester and ashless phosphorus-containing additive, e.g., zinc dihydrocarbyldithiophosphate, are present in the compositions of the present invention in a concentration in the range of from about 0.02 to about 20 wt %, preferably from about 0.2 to about 2.0 wt %.

DESCRIPTION OF THE PREFERRED EMBODIMENTS

As stated above, the class of anti-fatigue, anti-wear, and extreme pressure additives can have the following generic formula at least one hydroxy carboxylic acid ester or hydroxy polycarboxylic acid ester of the formula:

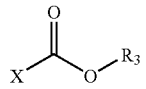

wherein X— and $R_3$ are as described above.

Preferred esters include citrates, tartrates, malates, lactates, mandelates, glycolates, hydroxy propionates, hydroxyglutarates, salicylates, and the like. Trialkyl citrates and borated trialkyl citrates are especially preferred, particularly triethyl citrate and borated triethyl citrate.

A particularly preferred class of anti-fatigue, anti-wear, and extreme pressure additives is one wherein $R_3$ is a linear or branched alkyl chain of 1 to 5 carbon atoms, e.g., methyl, ethyl, propyl, butyl, pentyl, isomers of the foregoing, and mixtures thereof. As noted above, it is preferred that $R_3$ be ethyl, and triethyl citrate and borated triethyl citrate are especially preferred embodiments. Such additives are advantageously employed in synergistic combination with at least one ashless phosphorus-containing additive, e.g., trilauryl phosphate or triphenylphosphorothionate, or a zinc dihydrocarbyldithiophosphate of the formula:

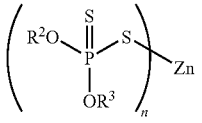

wherein n is 2, $R^2$ and $R^3$ are independently selected hydrocarbyl groups, preferably alkyl, cycloalkyl, aralkyl, alkaryl, or hydrocarbyl-substituted alkyl, cycloalkyl, aralkyl, or alkaryl groups, and wherein the $R^2$ and $R^3$ groups in the acid each have, on average, at least 3 carbon atoms. The preferred zinc dihydrocarbyldithiophosphate is a zinc dialkyldithiophosphate where the alkyl groups are linear or branched chains of 3-8 carbons, e.g., propyl, butyl, pentyl, hexyl, heptyl, octyl, isomers of the foregoing, and mixtures thereof.

Processes to make the hydroxy carboxylic acid ester and hydroxy polycarboxylic acid ester utilize the reaction of a hydroxy carboxylic acid or hydroxy polycarboxylic acid and an alcohol. The reaction is conducted with heating and with the removal of water as a by-product.

The hydroxy carboxylic acid ester and hydroxy polycarboxylic acid ester additives of the present invention are useful in synergistic combination with ashless phosphorus-containing additives, such as trilauryl phosphate or triphenylphosphorothionate, or with zinc dihydrocarbyldithiophosphate, which is an improvement over the prior art, as it permits a reduction of the amounts of zinc and phosphorus that are currently used, without diminishing anti-wear performance. The hydroxyl carboxylic acid ester and hydroxy They can also be used in combination with other additives typically found in lubricating oils, as well as with other anti-wear additives. The additives typically found in lubricating oils are, for example, dispersants, detergents, corrosion/rust inhibitors, antioxidants, anti-wear agents, anti-foamants, friction modifiers, seal swell agents, demulsifiers, V.I. improvers, pour point depressants, and the like. See, for example, U.S. Pat. No. 5,498,809 for a description of useful lubricating oil composition additives, the disclosure of which is incorporated herein by reference in its entirety.

As noted above, suitable anti-wear compositions include dihydrocarbyldithiophosphates. Preferably, the hydrocarbyl groups contain an average of at least 3 carbon atoms. Particularly useful are metal salts of at least one dihydrocarbyl dithiophosphoric acid wherein the hydrocarbyl groups contain an average of at least 3 carbon atoms. The acids from which the dihydrocarbyl dithiophosphates can be derived can be illustrated by acids of the formula:

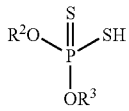

wherein $R^2$ and $R^3$ are the same or different and are alkyl, cycloalkyl, aralkyl, alkaryl, or substituted substantially hydrocarbon radical derivatives of any of the above groups, and wherein the $R^2$ and $R^3$ groups in the acid each have, on average, at least 3 carbon atoms. By "substantially hydrocarbon" is meant radicals containing atoms or groups, e.g., 1 to 4 substituent groups per radical moiety, such as ether, ester, nitro, halogen, or the like, that do not materially affect the hydrocarbon character of the radical.

Specific examples of suitable $R^2$ and $R^3$ radicals include isopropyl, isobutyl, n-butyl, sec-butyl, n-hexyl, heptyl, 2-ethylhexyl, diisobutyl, isooctyl, decyl, dodecyl, tetradecyl, hexadecyl, octadecyl, butylphenyl, o,p-dipentylphenyl, octylphenyl, polyisobutene-(molecular weight about 350)-substituted phenyl, tetrapropylene-substituted phenyl, β-octylbutylnaphthyl, cyclopentyl, cyclohexyl, phenyl, chlorophenyl, o-dichlorophenyl, bromophenyl, naphthenyl, 2-methylcyclohexyl, benzyl, chlorobenzyl, chloropentyl, dichlorophenyl, nitrophenyl, dichlorodecyl, xenyl, and similar radicals. Alkyl radicals having from about 3 to about 30 carbon atoms and aryl radicals having from about 6 to about 30 carbon atoms are preferred. Particularly preferred $R^2$ and $R^3$ radicals are alkyl of from 3 to 18 carbon atoms.

The phosphorodithioic acids are readily obtainable by the reaction of phosphorus pentasulfide and an alcohol or phenol. The reaction involves mixing, at a temperature of about 20° C. to 200° C., 4 moles of the alcohol or phenol with one mole of phosphorus pentasulfide. Hydrogen sulfide is liberated as the reaction takes place. Mixtures of alcohols, phenols, or both can be employed, e.g., mixtures of $C_3$ to $C_{30}$ alcohols, $C_6$ to $C_{30}$ aromatic alcohols, and the like.

The metals useful to make the phosphate salts include Group I metals, Group II metals, aluminum, lead, tin, molybdenum, manganese, cobalt, and nickel. Zinc is the preferred metal. Examples of metal compounds that can be reacted with the acid include lithium oxide, lithium hydroxide, lithium carbonate, lithium pentylate, sodium oxide, sodium hydroxide, sodium carbonate, sodium methylate, sodium propylate, sodium phenoxide, potassium oxide, potassium hydroxide, potassium carbonate, potassium methylate, silver oxide, silver carbonate, magnesium oxide, magnesium hydroxide, magnesium carbonate, magnesium ethylate, magnesium propylate, magnesium phenoxide, calcium oxide, calcium hydroxide, calcium carbonate, calcium methylate, calcium propylate, calcium pentylate, zinc oxide, zinc hydroxide, zinc carbonate, zinc propylate, strontium oxide, strontium hydroxide, cadmium oxide, cadmium hydroxide, cadmium carbonate, cadmium ethylate, barium oxide, barium hydroxide, barium hydrate, barium carbonate, barium ethylate, barium pentylate, aluminum oxide, aluminum propylate, lead oxide, lead hydroxide, lead carbonate, tin oxide, tin butylate, cobalt oxide, cobalt hydroxide, cobalt carbonate, cobalt pentylate, nickel oxide, nickel hydroxide, nickel carbonate, and the like.

In some instances, the incorporation of certain ingredients, particularly carboxylic acids or metal carboxylates, such as, small amounts of the metal acetate or acetic acid, used in conjunction with the metal reactant will facilitate the reaction and result in an improved product. For example, the use of up to about 5% of zinc acetate in combination with the required amount of zinc oxide facilitates the formation of a zinc phosphorodithioate.

The preparation of metal phosphorodithioates is well known in the art and is described in a large number of issued patents, including U.S. Pat. Nos. 3,293,181; 3,397,145; 3,396,109; and 3,442,804; the disclosures of which are hereby incorporated by reference. Also useful as anti-wear additives are amine derivatives of dithiophosphoric acid compounds, such as are described in U.S. Pat. No. 3,637,499, the disclosure of which is hereby incorporated by reference in its entirety.

The zinc salts are most commonly used as anti-wear additives in lubricating oil in amounts of 0.1 to 10, preferably 0.2 to 2, wt. %, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols can be used, including mixtures of primary and secondary alcohols, secondary generally for imparting improved anti-wear properties and primary for thermal stability. In general, any basic or neutral zinc compound could be used, but the oxides, hydroxides, and carbonates are most generally employed. Commercial additives frequently contain an excess of zinc owing to use of an excess of the basic zinc compound in the neutralization reaction.

The zinc dihydrocarbyl dithiophosphates (ZDDP) are oil-soluble salts of dihydrocarbyl esters of dithiophosphoric acids and can be represented by the following formula:

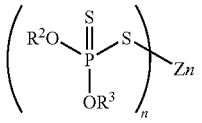

wherein n, $R^2$, and $R^3$ are as described above.

Examples of dispersants include polyisobutylene succinimides, polyisobutylene succinate esters, Mannich Base ashless dispersants, and the like. Examples of detergents include metallic and ashless alkyl phenates, metallic and ashless sulfurized alkyl phenates, metallic and ashless alkyl sulfonates, metallic and ashless alkyl salicylates, metallic and ashless saligenin derivatives, and the like.

Examples of antioxidants include alkylated diphenylamines, N-alkylated phenylenediamines, phenyl-α-naphthylamine, alkylated phenyl-α-naphthylamine, dimethyl quinolines, trimethyldihydroquinolines and oligomeric compositions derived therefrom, hindered phenolics, alkylated hydroquinones, hydroxylated thiodiphenyl ethers, alkylidenebisphenols, thiopropionates, metallic dithiocarbamates, 1,3,4-dimercaptothiadiazole and derivatives, oil soluble copper compounds, and the like. The following are exemplary of such additives and are commercially available from Crompton Corporation: Naugalube® 438, Naugalube 438L, Naugalube 640, Naugalube 635, Naugalube 680, Naugalube AMS, Naugalube APAN, Naugard® PANA, Naugalube TMQ, Naugalube 531, Naugalube 431, Naugard BHT, Naugalube 403, and Naugalube 420, among others.

Examples of additional anti-wear additives that can be used in combination with the additives of the present invention include organo-borates, organo-phosphites, organo-phosphates, organic sulfur-containing compounds, sulfurized olefins, sulfurized fatty acid derivatives (esters), chlorinated paraffins, dialkyldithiophosphate esters, diaryl dithiophosphate esters, phosphosulfurized hydrocarbons, and the like. The following are exemplary of such additives and are commercially available from The Lubrizol Corporation: Lubrizol 677A, Lubrizol 1095, Lubrizol 1097, Lubrizol 1360, Lubrizol 1395, Lubrizol 5139, and Lubrizol 5604, among others; and from Ciba Corporation: Irgalube 353.

Examples of friction modifiers include fatty acid esters and amides, organo molybdenum compounds, molybdenum dialkyldithiocarbamates, molybdenum dialkyl dithiophosphates, molybdenum disulfide, tri-molybdenum cluster dialkyldithiocarbamates, non-sulfur molybdenum compounds and the like. The following are exemplary of molybdenum additives and are commercially available from R.T.

Vanderbilt Company, Inc.: Molyvan A, Molyvan L, Molyvan 807, Molyvan 856B, Molyvan 822, Molyvan 855, among others. The following are also exemplary of such additives and are commercially available from Asahi Denka Kogyo K.K.: SAKURA-LUBE 100, SAKURA-LUBE 165, SAKURA-LUBE 300, SAKURA-LUBE 310G, SAKURA-LUBE 321, SAKURA-LUBE 474, SAKURA-LUBE 600, SAKURA-LUBE 700, among others. The following are also exemplary of such additives and are commercially available from Akzo Nobel Chemicals GmbH: Ketjen-Ox 77M, Ketjen-Ox 77TS, among others; and from Crompton Corporation: Naugalube® MolyFM 2543.

An example of an anti-foamant is polysiloxane, and the like. Examples of rust inhibitors are polyoxyalkylene polyol, benzotriazole derivatives, and the like. Examples of V.I. improvers include olefin copolymers and dispersant olefin copolymers, and the like. An example of a pour point depressant is polymethacrylate, and the like.

Lubricant Compositions

Compositions, when they contain these additives, are typically blended into a base oil in amounts such that the additives therein are effective to provide their normal attendant functions. Representative effective amounts of such additives are illustrated in TABLE 1.

TABLE 1

| Additives | Preferred Weight % | More Preferred Weight % |
|---|---|---|
| V.I. Improver | 1-12 | 1-4 |
| Corrosion Inhibitor | 0.01-3 | 0.01-1.5 |
| Oxidation Inhibitor | 0.01-5 | 0.01-1.5 |
| Dispersant | 0.1-10 | 0.1-5 |
| Lube Oil Flow Improver | 0.01-2 | 0.01-1.5 |
| Detergent/Rust Inhibitor | 0.01-6 | 0.01-3 |
| Pour Point Depressant | 0.01-1.5 | 0.01-0.5 |
| Anti-foaming Agents | 0.001-0.1 | 0.001-0.01 |
| Anti-wear Agents | 0.001-5 | 0.001-1.5 |
| Seal Swell Agents | 0.1-8 | 0.1-4 |
| Friction Modifiers | 0.01-3 | 0.01-1.5 |
| Lubricating Base Oil | Balance | Balance |

When other additives are employed, it may be desirable, although not necessary, to prepare additive concentrates comprising concentrated solutions or dispersions of the subject additives of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil can be facilitated by solvents and by mixing accompanied by mild heating, but this is not essential. The concentrate or additive-package will typically be formulated to contain the additives in proper amounts to provide the desired concentration in the final formulation when the additive-package is combined with a predetermined amount of base lubricant. Thus, the subject additives of the present invention can be added to small amounts of base oil or other compatible solvents along with other desirable additives to form additive-packages containing active ingredients in collective amounts of, typically, from about 2.5 to about 90 percent, preferably from about 15 to about 75 percent, and more preferably from about 25 percent to about 60 percent by weight additives in the appropriate proportions with the remainder being base oil. The final formulations can typically employ about 1 to 20 weight percent of the additive-package with the remainder being base oil.

All of the weight percentages expressed herein (unless otherwise indicated) are based on the active ingredient (AI) content of the additive, and/or upon the total weight of any additive-package, or formulation, which will be the sum of the AI weight of each additive plus the weight of total oil or diluent.

In general, the lubricant compositions of the invention contain the additives in a concentration ranging from about 0.05 to about 30 weight percent. A concentration range for the additives ranging from about 0.1 to about 10 weight percent based on the total weight of the oil composition is preferred. A more preferred concentration range is from about 0.2 to about 5 weight percent. Oil concentrates of the additives can contain from about 1 to about 75 weight percent of the additive reaction product in a carrier or diluent oil of lubricating oil viscosity.

In general, the additives of the present invention are useful in a variety of lubricating oil base stocks. The lubricating oil base stock is any natural or synthetic lubricating oil base stock fraction having a kinematic viscosity at 100° C. of about 2 to about 200 cSt, more preferably about 3 to about 150 cSt, and most preferably about 3 to about 100 cSt. The lubricating oil base stock can be derived from natural lubricating oils, synthetic lubricating oils, or mixtures thereof. Suitable lubricating oil base stocks include base stocks obtained by isomerization of synthetic wax and wax, as well as hydrocracked base stocks produced by hydrocracking (rather than solvent extracting) the aromatic and polar components of the crude. Natural lubricating oils include animal oils, such as lard oil, vegetable oils (e.g., canola oils, castor oils, sunflower oils), petroleum oils, mineral oils, and oils derived from coal or shale.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers. Other esters useful as synthetic oils include those made from copolymers of α-olefins and dicarboxylic acids which are esterified with short or medium chain length alcohols. The following are exemplary of such additives and are commercially available from Akzo Nobel Chemicals SpA: Ketjenlubes 115, 135, 165, 1300, 2300, 2700,305, 445, 502, 522, and 6300, among others.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly α-olefins, and the like.

The lubricating oil may be derived from unrefined, refined, re-refined oils, or mixtures thereof. Unrefined oils are obtained directly from a natural source or synthetic source (e.g., coal, shale, or tar and bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to unrefined oils, except that refined oils have been treated in one or more purification steps to improve one or more properties. Suitable purification techniques include distillation, hydrotreating, dewaxing, solvent extraction, acid or base extraction, filtration, percolation, and the like, all of which are well-known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst. Natural waxes are typically the slack waxes recovered by the solvent dewaxing of mineral oils; synthetic waxes are typically the waxes produced by the Fischer-Tropsch process. The resulting isomerate product is typically subjected to solvent dewaxing and fractionation to recover various fractions having a specific viscosity range. Wax isomerate is also characterized by possessing very high viscosity indices, generally having a V.I. of at least 130, preferably at least 135 or higher and, following dewaxing, a pour point of about −20° C. or lower.

The additives of the present invention are especially useful as components in many different lubricating oil compositions. The additives can be included in a variety of oils with lubricating viscosity, including natural and synthetic lubricating oils and mixtures thereof. The additives can be included in crankcase lubricating oils for spark-ignited and compression-ignited internal combustion engines. The compositions can also be used in gas engine lubricants, turbine lubricants, automatic transmission fluids, gear lubricants, compressor lubricants, metal-working lubricants, hydraulic fluids, and other lubricating oil and grease compositions. The additives can also be used in motor fuel compositions.

The advantages and the important features of the present invention will be more apparent from the following examples.

EXAMPLES

Anti-Wear Four-Ball Testing

The anti-wear properties of the hydroxy carboxylic acid esters in a fully formulated American Petroleum Institute (API) Group II lubricating oil were determined in the Four-Ball Wear Test under the ASTM D 4172 test conditions. The testing for these examples was done on a Falex Variable Drive Four-Ball Wear Test Machine. Four balls are arranged in an equilateral tetrahedron. The lower three balls are clamped securely in a test cup filled with lubricant and the upper ball is held by a chuck that is motor-driven. The upper ball rotates against the fixed lower balls. Load is applied in an upward direction through a weight/lever arm system. Loading is through a continuously variable pneumatic loading system. Heaters allow operation at elevated oil temperatures. The three stationary steel balls are immersed in 10 milliliters of sample to be tested, and the fourth steel ball is rotated on top of the three stationary balls in "point-to-point contact." The machine is operated for one hour at 75° C. with a load of 40 kilograms and a rotational speed of 1,200 revolutions per minute. The fully formulated lubricating oil contained all the additives typically found in a motor oil (with different anti-wear agents as noted in TABLE 2) as well as 0.63 wt. % cumene hydroperoxide to help simulate the environment within a running engine, and 2.40% Pennzoil Excel 100 HC. The additives were tested for effectiveness in a motor oil formulation and compared to identical formulations with and without any zinc dialkyldithiophosphate. It will be apparent from examination of the data that the use of these hydroxy ester additives in combination with phosphorus-containing additives offers synergistic improvement in performance over either type of additive alone.

Anti-Wear Cameron-Plint TE77 High Frequency Friction Machine Testing

The anti-wear properties of the additives of this invention in a fully formulated API Group II lubricating oil were determined in the Cameron-Plint TE77 High Frequency Friction Machine Test. The specimen parts (6 mm diameter AISI 52100 steel ball of 800±20 kg/mm$^2$ hardness and hardened ground NSOH B01 gauge plate of RC 60/0.4 micron) were rinsed and then sonicated for 15 minutes with technical grade hexanes. This procedure was repeated with isopropyl alcohol. The specimens were dried with nitrogen and set into the TE77. The oil bath was filled with 10 mL of sample. The test was run at a 30 Hertz Frequency, 100 Newton Load, 2.35 mm amplitude. The test starts with the specimens and oil at room temperature. Immediately, the temperature was ramped over 15 minutes to 50° C., where it dwelled for 15 minutes. The temperature was then ramped over 15 minutes to 100° C., where it dwelled for 45 minutes. A third temperature ramp over 15 minutes to 150° C. was followed by a final dwell at 150° C. for 15 minutes. The total length of the test was 2 hours. At the end of the test, the wear scar diameter on the 6 mm ball was measured using a Leica StereoZoom6® Stereomicroscope and a Mitutoyo 164 series Digimatic Head. The fully formulated lubricating oils tested contained 1 wt. % cumene hydroperoxide to help simulate the environment within a running engine. The additives were tested for effectiveness in motor oil formulations and compared to identical formulations with and without any zinc dialkyldithiophosphate. In TABLE 2 the numerical value of the test results (Wear Scar Diameter, mm) decreases with an increase in effectiveness. Also determined was the maximum depth of the wear scar on the plate. This is measured using a profilometer.

The following example numbers refer to TABLE 2.

Examples 1-5

Triethyl citrate was used as obtained from Aldrich.

Example 6

Tripentyl Citrate with Ethyl Dipentyl Citrate

A 500 mL 3-neck flask, equipped with a subsurface nitrogen inlet, a magnetic stir bar, and a heated Alihn condenser which led to a water cooled short path condenser was charged with 22.92 grams of triethyl citrate, 177.86 grams of 1-pentanol, and 1.51 grams of p-toluenesulfonic acid. The Alihn condenser was heated with fluid from a 90° C. circulating bath. The mixture was stirred at reflux for 24 hours. The reaction mixture was diluted in heptanes, and washed once with dilute sodium hydroxide, then five times with water. Solvent was removed by rotary evaporator. The product contained 83% tripentyl esters and 15% dipentylesters as determined by GC.

Examples 7-8

Borated Triethyl Citrate

A 100 mL three-neck flask, equipped with an overhead stirrer, a Claisen adapter with a thermocouple and a 16 gauge needle for use as a subsurface nitrogen sparge, and a short path condenser, was charged with 61.88 grams of triethyl citrate and 5.04 grams of boric acid. The mixture was heated at 119° C. for 5.5 hours. On two occasions during this time a heat gun was used to help break up and dissolve solids deposited on the sides of the reactor. The temperature briefly rose to 140° C. during the heat gun usage. The reaction mixture was filtered through Celite 545 diatomaceous earth. Volatiles were removed by rotary evaporation to yield 58.8 grams of a straw-colored liquid.

Example 9

Tributyl citrate was used as received from Unitex Chemical Corp.

Examples 10-11

Transesterification Product of Triethylcitrate with 2-Methoxy Ethanol

A 500 mL 3-neck flask, equipped with a subsurface nitrogen inlet, a magnetic stir bar, and a heated Alihn condenser which led to a water cooled short path condenser was charged with 22.92 grams of triethyl citrate, 153.7 grams of 2-methoxyethanol, and 1.5 grams of p-toluenesulfonic acid. The Alihn condenser was heated with fluid from a 90° C. circulating bath. The mixture was stirred at 121-124° C. An aliquot sample was removed after 15 hours, and the reaction was terminated at 20 hours. Each portion was diluted in butyl acetate and washed once with dilute sodium hydroxide, then with water. The samples were dried over sodium sulfate, filtered, and volatiles were removed by rotary evaporator.

The 15 hour sample contained 6% triethyl citrate, 35% diethyl-methoxyethyl citrates, 53% ethyl di-methoxyethyl citrates and 6% tri-methyoxyethyl citrates by GC. (Example D).

The 20 hour sample contained 8% diethyl-methoxyethyl 1 citrates, 77% ethyl di-methoxyethyl citrates and 13% tri-methyoxyethyl citrates by GC. (Example E).

Example 12

Triethyl Citrate Transesterified with 1,2-Propanediol

A 500 mL 3-neck flask, equipped with a subsurface nitrogen inlet, a magnetic stir bar, and a heated Alihn condenser which led to a water cooled short path condenser was charged with 22.9 grams of triethyl citrate, 153.7 grams of 1,2-propanediol, and 1.5 grams of p-toluenesulfonic acid. The Alihn condenser was heated with fluid from a 90° C. circulating bath. The mixture was stirred at 125° C. for 19 hours. The reaction mixture was diluted in butyl acetate and washed once with dilute sodium hydroxide, then with water. The product was dried over sodium sulfate, filtered, and volatiles were removed by rotary evaporator. The product was a complex mixture of di- and triesters.

Examples 13-14

Triethyl O-acetyl citrate was used as obtained from Aldrich.

Example 15

Triethyl Citrate Octadecyl Succinate Derivative

A 100 mL three-neck flask, equipped with an overhead stirrer, a Claisen adapter with a thermocouple, a nitrogen inlet, and a short path condenser, was charged with 25.9 grams of triethyl citrate and 31.74 grams of octadecenyl succinic anhydride, 13.1 mL triethylamine, and 1.5 grams of dimethylaminopyridine. The reaction was stirred at 55° C. for 6.5 hours. The reaction mixture was diluted in xylenes and extracted once with dilute hydrochloric acid, and then washed three times with water. The product was dried over magnesium sulfate, filtered, and volatiles were removed by rotary evaporator. The product was a brown liquid.

Example 16

Dimethyl L-tartrate was used as obtained from Acros.

Example 17

(+) Diisopropyl L-tartrate was used as obtained from Acros.

Examples 18-21

Dibutyl L-tartrate was used as obtained from Acros.

Example 19

Borated Dibutyl Tartrate

A 50 mL three-neck flask, equipped with an overhead stirrer, a Claisen adapter with a thermocouple and a nitrogen inlet, and a short path condenser, was charged with 23.93 grams of dibutyl tartrate and 1.88 grams (0.33 mol eq) of boric acid. The reaction was stirred at 123° C. for one hour. The resulting product was decanted to yield 22.2 grams of a pale straw-colored oil.

Example 20

Borated Dibutyl Tartrate

A 50 mL three-neck flask, equipped with an overhead stirrer, a Claisen adapter with a thermocouple and a nitrogen inlet, and a short path condenser, was charged with 26.44 grams of dibutyl tartrate and 4.15 grams (0.67 mol eq) of boric acid. The reaction was stirred at 123° C. for 100 minutes. The resulting product was decanted to yield 11.71 grams of a viscous amber liquid.

Examples 22-23

Dibutyl Malate

A 100 mL three-neck flask, equipped with a magnetic stir bar, a Claisen adapter with a thermocouple and a nitrogen inlet, and a short path condenser, was charged with 4.45 grams of dimethyl malate, 40 mL 1-butanol, and 0.51 gram of p-toluenesulfonic acid. The reaction was stirred at 115° C. for 3.7 hours with a nitrogen sweep. The reaction mixture was taken up in ethyl acetate, extracted with dilute aqueous sodium bicarbonate, washed three times with water, dried over magnesium sulfate, and filtered. Solvent was removed by rotary evaporation to yield 6.8 grams of a straw-colored liquid.

Example 24

Methyl(S)-(−)-lactate was used as obtained from Aldrich.

Examples 25-26 n-Butyl lactate was used as obtained from Acros.

Examples 27-28

Pentyl Mandelate

A 100 mL three-neck flask, equipped with a magnetic stir bar, a Claisen adapter with a thermocouple and a subsurface nitrogen inlet, and a short path condenser, was charged with 7.94 grams of ethyl mandelate, 40 mL of 1-pentanol, and 0.75 gram of p-toluenesulfonic acid. The reaction was stirred at 120°-132° C. for 4.0 hours with a nitrogen sweep. The reaction mixture was taken up in butyl acetate, extracted with dilute aqueous sodium hydroxide, washed three times with water, dried over magnesium sulfate, and filtered. Solvent was removed by rotary evaporation to yield 8.3 grams of a straw-colored liquid.

Examples 29-30

Ethyl glycolate was used as received from Aldrich.

Examples 31-32

Methyl-2,2-dimethyl-3-hydroxypropionate was used as obtained from Aldrich.

Examples 33-34

Diethyl-3-hydroxyglutarate was used as obtained from Aldrich.

Examples 35-36

Methyl salicylate was used as obtained from Aldrich.

Examples 37-38

Dipentyl-5-hydroxyisophthalate

A 100 mL three-neck flask, equipped with a magnetic stir bar, a Claisen adapter with a thermocouple and a subsurface nitrogen inlet, and a short path condenser, was charged with 5.31 grams of dimethyl-5-hydroxyisophthalate, 44 mL of 1-pentanol, and 0.53 gram of p-toluenesulfonic acid. The reaction was stirred at 129° C. for 6.3 hours with a nitrogen sweep. The reaction mixture was taken up in xylenes, extracted with dilute aqueous sodium bicarbonate, washed twice with water, dried over magnesium sulfate, and filtered. Solvent was removed by rotary evaporation to yield 7.3 grams of a straw-colored liquid.

Examples 39-43

Irgalube TPPT (triphenyl phosphorothionate) was used as obtained from Ciba.

Examples 44-48

Weston TLP (trilauryl phosphate) was used as available from Crompton.

TABLE 2

Summary of Anti-wear Testing of Hydroxy-Carboxylic Acid Esters Alone and in Combination with ZDDP on an Equal Weight Basis - Average Results

| | | | Falex 4-Ball Avg. Wear | Cameron-Plint | |
|---|---|---|---|---|---|
| Example | Weight % Anti-Wear | Anti-Wear Chemical Name/Blend | Scar Diameter (mm) | Average Ball Scars (mm) | Ave. Plate Scars Depth (mm) |
| A (Comparative) | 1.00 | ZDDP | 0.481 | 0.424 | 1.79 |
| B (Comparative) | 0.5 | ZDDP | 0.483 | 0.623 | 9.42 |
| C (Comparative) | No Anti-Wear | — | 0.794 | 0.754 | 15.54 |
| 1 | 1.00 | Triethyl Citrate | 0.497 | 0.587 | 2.130 |
| 2 | 0.50 | Triethyl Citrate | 0.570 | | |
| 3 | 0.75/0.25 | Triethyl Citrate/ ZDDP | 0.508 | 0.551 | 2.406 |
| 4 | 0.50/0.50 | Triethyl Citrate/ ZDDP | 0.370 | 0.463 | 2.049 |
| 5 | 0.25/0.75 | Triethyl Citrate/ ZDDP | 0.385 | 0.423 | 1.949 |
| 6 | 1.00 | Ethyl dipentyl citrate: | 0.595 | | |

TABLE 2-continued

Summary of Anti-wear Testing of Hydroxy-Carboxylic Acid Esters Alone and in Combination with ZDDP on an Equal Weight Basis - Average Results

| Example | Weight % Anti-Wear | Anti-Wear Chemical Name/Blend | Falex 4-Ball Avg. Wear Scar Diameter (mm) | Cameron-Plint Average Ball Scars (mm) | Cameron-Plint Ave. Plate Scars Depth (mm) |
|---|---|---|---|---|---|
| | | tripentyl citrate (1:5) | | | |
| 7 | 1.00 | Borated triethyl citrate | 0.421 | | |
| 8 | 0.50/0.50 | Borated triethyl citrate/ ZDDP | 0.341 | | |
| 9 | 1.00 | Tributyl citrate | 0.608 | | |
| 10 | 1.00 | R.P of triethylcitrate and 2-methoxy ethanol | 0.475 | | |
| 11 | 1.00 | R.P of triethylcitrate and 2-methoxy ethanol | 0.553 | | |
| 12 | 1.00 | R.P of triethylcitrate and 1,2-propanediol | 0.478 | | |
| 13 | 1.00 | triethyl O-acetyl citrate | 0.611 | | |
| 14 | 0.50/0.50 | triethyl O-acetyl citrate/ZDDP | 0.547 | | |
| 15 | 1.00 | Triethyl citrate octadecyl succinate derivative | 0.725 | | |
| 16 | 1.00 | Dimethyl L-tartrate | 0.510 | | |
| 17 | 1.00 | (+) Diisopropyl L-tartrate | 0.453 | | |
| 18 | 1.00 | Dibutyl L-tartrate | 0.426 | | |
| 19 | 1.00 | Borated dibutyl L-tartrate | 0.414 | | |
| 20 | 1.00 | Borated dibutyl L-tartrate | 0.528 | | |
| 21 | 0.50/0.50 | Dibutyl L-tartrate/ ZDDP | 0.360 | | |
| 22 | 1.00 | Dibutyl malate | 0.495 | | |
| 23 | 0.50/0.50 | Dibutyl malate/ ZDDP | 0.382 | | |
| 24 | 1.00 | Methyl (S)-(−)-lactate | 0.454 | | |
| 25 | 1.00 | n-Butyl lactate | 0.383 | | |
| 26 | 0.50/0.50 | n-Butyl lactate/ ZDDP | 0.351 | | |
| 27 | 1.00 | Pentyl mandelate | 0.458 | | |
| 28 | 0.50/0.50 | Pentyl mandelate/ZDDP | 0.482 | | |
| 29 | 1.00 | Ethyl glycolate | 0.492 | | |
| 30 | 0.50/0.50 | Ethyl glycolate/ZDDP | 0.455 | | |
| 31 | 1.00 | MDHP[1] | 0.416 | | |

TABLE 2-continued

Summary of Anti-wear Testing of Hydroxy-Carboxylic Acid Esters Alone and in Combination with ZDDP on an Equal Weight Basis - Average Results

| Example | Weight % Anti-Wear | Anti-Wear Chemical Name/Blend | Falex 4-Ball Avg. Wear Scar Diameter (mm) | Cameron-Plint Average Ball Scars (mm) | Cameron-Plint Ave. Plate Scars Depth (mm) |
|---|---|---|---|---|---|
| 32 | 0.50/0.50 | MDHP/ ZDDP | 0.359 | | |
| 33 | 1.00 | Diethyl-3-hydroxy glutarate | 0.547 | | |
| 34 | 0.50/0.50 | Diethyl-3-hydroxy glutarate/ ZDDP | 0.459 | | |
| 35 | 1.00 | methyl salicylate | 0.522 | | |
| 36 | 0.50/0.50 | methyl salicylate/ ZDDP | 0.374 | | |
| 37 | 1.00 | Dipentyl-5-hydroxy-isophthalate | 0.382 | | |
| 38 | 0.50/0.50 | Dipentyl-5-hydroxy-isophthalate/ ZDDP | 0.344 | | |
| 39 | 1.00 | Irgalube TPPT | 0.622 | | |
| 40 | 0.50 | Irgalube TPPT | 0.748 | | |
| 41 | 0.75/0.25 | Triethyl citrate/ Irgalube TPPT | 0.491 | | |
| 42 | 0.50/0.50 | Triethyl citrate/ Irgalube TPPT | 0.539 | | |
| 43 | 0.25/0.75 | Triethyl citrate/ Irgalube TPPT | 0.527 | | |
| 44 | 1.00 | Weston TLP | 0.859 | | |
| 45 | 0.50 | Weston TLP | 0.672 | | |
| 46 | 0.75/0.25 | Triethyl citrate/ Weston TLP | 0.585 | | |
| 47 | 0.50/0.50 | Triethyl citrate/ Weston TLP | 0.484 | | |
| 48 | 0.25/0.75 | Triethyl citrate/ Weston TLP | 0.530 | | |

[1]Methyl-2,2-dimethyl-3-hydroxypropionate

In view of the many changes and modifications that can be made without departing from principles underlying the invention, reference should be made to the appended claims for an understanding of the scope of the protection to be afforded the invention.

What is claimed is:

1. A composition comprising:

(A) a lubricant; and (B) from 0.01 to 5 wt % of at least one hydroxy carboxylic acid ester or hydroxy polycarboxylic acid ester having the following generic formula:

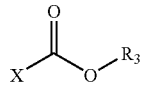

wherein: $R_3$ is selected from the group consisting of $C_1$-$C_{18}$ linear or branched alkyl, $C_1$-$C_{18}$ linear or branched alkenyl, alkoxyalkyl, hydroxyalkyl, aryl, and benzyl; and X— is selected from the group consisting of

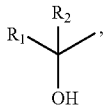

and

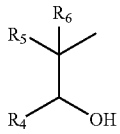

wherein:

$R_1$ is selected from the group consisting of hydrogen, $CH_2CO_2R_3$, $CH(OH)CO_2R_3$, alkyl, aryl, alkoxyalkyl, and alkaryl;

$R_2$ is selected from the group consisting of hydrogen, alkyl, and $CH_2CO_2R_3$; provided that:

if $R_1$ is $CH_2CO_2R_3$, then $R_2$ is hydrogen or $CH_2CO_2R_3$;

if $R_1$ is $CH(OH)CO_2R_3$, then $R_2$ is hydrogen;

if $R_1$ is alkyl, aryl, alkoxyalkyl, or alkaryl, then $R_2$ is hydrogen or alkyl;

$R_4$ is selected from the group consisting of hydrogen, alkyl, aryl, and $CH_2CO_2R_3$; and $R_5$ and $R_6$ are independently selected from the group consisting of hydrogen, alkyl, and aryl;

and (C) from 0.01 to 2 wt % of at least one phosphorus-containing additive.

2. The composition of claim 1 wherein the hydroxy carboxylic acid ester or hydroxy polycarboxylic acid ester is selected from the group consisting of citrates, tartrates, malates, lactates, mandelates, glycolates, hydroxy propionates, hydroxyglutarates, and mixtures thereof.

3. The composition of claim 2 wherein the hydroxy carboxylic acid ester or hydroxy polycarboxylic acid ester is trialkyl citrate.

4. The composition of claim 3 wherein the trialkyl citrate is selected from the group consisting of triethyl citrate, tributyl citrate, and mixtures thereof.

5. A method for improving the anti-fatigue, anti-wear, and extreme pressure properties of lubricants comprising adding to said lubricants (A) from 0.01 to 5 wt % of at least one hydroxy carboxylic acid ester or hydroxy polycarboxylic acid ester having the following generic formula:

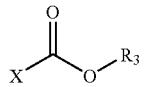

wherein: $R_3$ is selected from the group consisting of $C_1$-$C_{18}$ linear or branched alkyl, $C_1$-$C_{18}$ linear or branched alkenyl, alkoxyalkyl, hydroxyalkyl, aryl, and benzyl; and X— is selected from the group consisting of

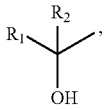

and

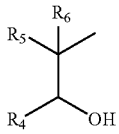

wherein:

$R_1$ is selected from the group consisting of hydrogen, $CH_2CO_2R_3$, $CH(OH)CO_2R_3$, alkyl, aryl, alkoxyalkyl, and alkaryl;

$R_2$ is selected from the group consisting of hydrogen, alkyl, and $CH_2CO_2R_3$; provided that:

if $R_1$ is $CH_2CO_2R_3$, then $R_2$ is hydrogen or $CH_2CO_2R_3$;

if $R_1$ is $CH(OH)CO_2R_3$, then $R_2$ is hydrogen;

if $R_1$ is alkyl, aryl, alkoxyalkyl, or alkaryl, then $R_2$ is hydrogen or alkyl;

$R_4$ is selected from the group consisting of hydrogen, alkyl, aryl, and $CH_2CO_2R_3$; and $R_5$ and $R_6$ are independently selected from the group consisting of hydrogen, alkyl, and aryl; and (B) from 0.01 to 2 wt % of at least one phosphorus-containing additive.

6. The method of claim 5 wherein the hydroxy carboxylic acid ester or hydroxy polycarboxylic acid ester is selected from the group consisting of citrates, tartrates, malates, lactates, mandelates, glycolates, hydroxy propionates, hydroxyglutarates, and mixtures thereof.

7. The method of claim 6 wherein the ester is selected from the group consisting of triethyl citrate, tributyl citrate, and mixtures thereof.

8. The composition of claim 1, wherein the combination of said at least one hydroxy carboxylic acid ester or hydroxy polycarboxylic acid ester and said phosphorus-containing additive are present in the range from 0.2 to 2.0 wt %.

9. The composition of claim 1, wherein said at least one hydroxy carboxylic acid ester or hydroxy polycarboxylic acid ester is present in the range from 0.5 to 1.0 wt %.

10. The composition of claim 1, wherein said phosphorus-containing additive is present in the range from 0.25 to 0.75 wt %.

11. The method of claim 5, wherein the combination of said at least one hydroxy carboxylic acid ester or hydroxy polycarboxylic acid ester and said phosphorus-containing additive are present in the range from 0.2 to 2.0 wt %.

12. The method of claim 5, wherein said at least one hydroxy carboxylic acid ester or hydroxy polycarboxylic acid ester is present in the range from 0.5 to 1.0 wt %.

13. The method of claim 5, wherein said phosphorus-containing additive is present in the range from 0.25 to 0.75 wt %.

14. The method of claim 5, wherein said phosphorus-containing additive is selected from the group consisting of zinc dialkyldithiophosphate, zinc diaryldithiophosphate, zinc alkylaryldithiophosphate, monohydrocarbyl dihydrogen phosphites, dihydrocarbyl hydrogen phosphites, trihydrocarbyl phosphites, diphosphites, triphosphites, polyphosphites, dithiophosphates, trithiophosphates, monohydrocarbyl dihydrogen phosphates, dihydrocarbyl hydrogen phosphates, trihydrocarbyl phosphates, amine phosphates, phosphonites, diphosphonites, and phosphorothionates.

15. The method of claim 5, wherein the phosphorus-containing additive is a zinc dihydrocarbyldithiophosphate of formula (II):

(II)

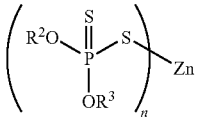

wherein n is 2 and $R^2$ and $R^3$ are independently selected from the group consisting of alkyl, cycloalkyl, aralkyl, and alkaryl.

16. The method of claim 5, wherein said phosphorus-containing additive is selected from the group consisting of dibutyl phosphite, dihexyl phosphite, dicyclohexyl phosphite, diisodecyl phosphite, di-n-octylphosphite, diphenyl isodecyl phosphite, diphenyl phosphite, di-n-octyl phosphite, dioleyl hydrogen phosphite, dimethylphenyl phosphite, ethyl hexyl diphenyl phosphite, phenyl diisodecyl phosphite, triisodecyl phosphite, triisoocytyl phosphite, trilauryl phosphite, triphenyl phosphite, tris(dipropyleneglycol)phosphite, tris(nonylphenyl)phosphite, tris(2,4-di-t-butylphenyl)phosphite, tris(5-norbornene-2-methyl)phosphite, tris(tridecyl)phosphite, bis(2,4-di-t-butylphenyl)pentaerythritol diphosphite, bis(2,6-di-t-butyl-4-methylphenyl)pentaerythritol diphosphite, bis(2,4-dicumylphenyl)pentaerythritol diphosphite, diisodecyl pentaerythritol diphosphite, distearyl pentaerythritol diphosphites, heptakis(dipropyleneglycol)triphosphite, tetraphenyl dipropyleneglycol diphosphite, tetrakis(2,4-di-t-butylphenyl)-4,4'-biphenylene diphosphite, poly(dipropyleneglycol) phenyl phosphite, poly 4,4'isopropylidenediphenol-$C_{12}$-$C_{15}$ alcohol phosphite, alkyl ($C_{10}$) bisphenol A phosphite, alkyl ($C_{12}$-$C_{15}$) bisphenol A phosphite, tris(dipropyleneglycol) phosphite, phenyl neopentylene glycol phosphite, 2,4,6-tri-t-butylphenyl-2-butyl-2-ethyl-1,3 propanediol phosphite; 2,2-methylenebis(4,6-di-t-butylphenyl) 2-ethylhexyl phosphite, trilauryl trithiophosphite, tributyl phosphate, triphenyl phosphate, tritolyl phosphate, triphenyl phosphorothionate, tris(nonylphenyl) phosphorothionate and tris(butylphenyl)phosphorothionate.

17. The composition of claim 1, wherein said phosphorus-containing additive is selected from the group consisting of zinc dialkyldithiophosphate, zinc diaryldithiophosphate, zinc alkylaryldithiophosphate, monohydrocarbyl dihydrogen phosphites, dihydrocarbyl hydrogen phosphites, trihydrocarbyl phosphites, diphosphites, triphosphites, polyphosphites, dithiophosphates, trithiophosphates, monohydrocarbyl dihydrogen phosphates, dihydrocarbyl hydrogen phosphates, trihydrocarbyl phosphates, amine phosphates, phosphonites, diphosphonites, and phosphorothionates.

18. The composition of claim 1, wherein the phosphorus-containing additive is a zinc dihydrocarbyldithiophosphate of formula (II):

(II)

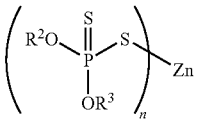

wherein n is 2 and $R^2$ and $R^3$ are independently selected from the group consisting of alkyl, cycloalkyl, aralkyl, and alkaryl.

19. The composition of claim 1, wherein said phosphorus-containing additive is selected from the group consisting of dibutyl phosphite, dihexyl phosphite, dicyclohexyl phosphite, diisodecyl phosphite, di-n-octylphosphite, diphenyl isodecyl phosphite, diphenyl phosphite, di-n-octyl phosphite, dioleyl hydrogen phosphite, dimethylphenyl phosphite, ethyl hexyl diphenyl phosphite, phenyl diisodecyl phosphite, triisodecyl phosphite, triisoocytyl phosphite, trilauryl phosphite, triphenyl phosphite, tris(dipropyleneglycol)phosphite, tris(nonylphenyl)phosphite, tris(2,4-di-t-butylphenyl)phosphite, tris(5-norbornene-2-methyl)phosphite, tris(tridecyl)phosphite, bis(2,4-di-t-butylphenyl)pentaerythritol diphosphite, bis(2,6-di-t-butyl-4-methylphenyl)pentaerythritol diphosphite, bis(2,4-dicumylphenyl)pentaerythritol diphosphite, diisodecyl pentaerythritol diphosphite, distearyl pentaerythritol diphosphites, heptakis(dipropyleneglycol) triphosphite, tetraphenyl dipropyleneglycol diphosphite, tetrakis(2,4-di-t-butylphenyl)-4,4'-biphenylene diphosphite, poly(dipropyleneglycol)phenyl phosphite, poly 4,4'isopropylidenediphenol-$C_{12}$-$C_{15}$ alcohol phosphite, alkyl ($C_{10}$) bisphenol A phosphite, alkyl ($C_{12}$-$C_{15}$) bisphenol A phosphite, tris(dipropyleneglycol)phosphite, phenyl neopentylene glycol phosphite, 2,4,6-tri-t-butylphenyl-2-butyl-2-ethyl-1,3 propanediol phosphite; 2,2-methylenebis(4,6-di-t-butylphenyl) 2-ethylhexyl phosphite, trilauryl trithiophosphite, tributyl phosphate, triphenyl phosphate, tritolyl phosphate, triphenyl phosphorothionate, tris(nonylphenyl)phosphorothionate and tris(butylphenyl)phosphorothionate.

20. A composition comprising:

(A) a lubricant; and (B) from 0.01 to 5 wt % of at least one hydroxy carboxylic acid ester or hydroxy polycarboxylic acid ester having the following generic formula:

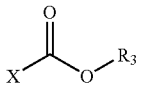

wherein: $R_3$ is selected from the group consisting of $C_1$-$C_{18}$ linear or branched alkyl, $C_1$-$C_{18}$ linear or branched alkenyl, alkoxyalkyl, hydroxyalkyl, aryl, and benzyl; and X— is selected from the group consisting of

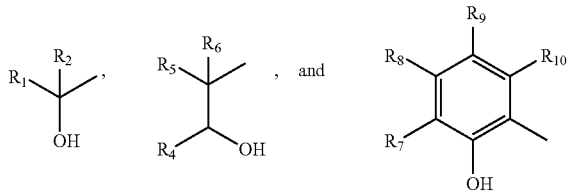

wherein:

$R_1$ is selected from the group consisting of hydrogen, $CH_2CO_2R_3$, $CH(OH)CO_2R_3$, alkyl, aryl, alkoxyalkyl, and alkaryl;

$R_2$ is selected from the group consisting of hydrogen, alkyl, and $CH_2CO_2R_3$; provided that:

if $R_1$ is $CH_2CO_2R_3$, then $R_2$ is hydrogen or $CH_2CO_2R_3$;

if $R_1$ is $CH(OH)CO_2R_3$, then $R_2$ is hydrogen;

if $R_1$ is alkyl, aryl, alkoxyalkyl, or alkaryl, then $R_2$ is hydrogen or alkyl;

$R_4$ is selected from the group consisting of hydrogen, alkyl, aryl, and $CH_2CO_2R_3$;

$R_5$ and $R_6$ are independently selected from the group consisting of hydrogen, alkyl, and aryl; and $R_7$, $R_8$, $R_9$, and $R_{10}$ are independently selected from the group consisting of hydrogen, $CO_2R_3$, alkyl, and fused aryl; and (C) from 0.01 to 2 wt % of at least one phosphorus-containing additive selected from the group consisting of dibutyl phosphite, dihexyl phosphite, dicyclohexyl phosphite, diisodecyl phosphite, di-n-octylphosphite, diphenyl isodecyl phosphite, diphenyl phosphite, di-n-octyl phosphite, dioleyl hydrogen phosphite, dimethylphenyl phosphite, ethyl hexyl diphenyl phosphite, phenyl diisodecyl phosphite, triisodecyl phosphite, triisoocytyl phosphite, trilauryl phosphite, triphenyl phosphite, tris(dipropyleneglycol)phosphite, tris(nonylphenyl)phosphite, tris(2,4-di-t-butylphenyl)phosphite, tris(5-norbornene-2-methyl)phosphite, tris(tridecyl) phosphite, bis(2,4-di-t-butylphenyl)pentaerythritol diphosphite, bis(2,6-di-t-butyl-4-methylphenyl)pentaerythritol diphosphite, bis(2,4-dicumylphenyl)pentaerythritol diphosphite, diisodecyl pentaerythritol diphosphite, distearyl pentaerythritol diphosphites, heptakis(dipropyleneglycol)triphosphite, tetraphenyl dipropyleneglycol diphosphite, tetrakis(2,4-di-t-butylphenyl)-4,4'-biphenylene diphosphite, poly(dipropyleneglycol) phenyl phosphite, poly 4,4'isopropylidene-diphenol-$C_{12}$-$C_{15}$ alcohol phosphite, alkyl ($C_{10}$) bisphenol A phosphite, alkyl ($C_{12}$-$C_{15}$) bisphenol A phosphite, tris(dipropyleneglycol)phosphite, phenyl neopentylene glycol phosphite, 2,4,6-tri-t-butylphenyl-2-butyl-2-ethyl-1,3 propanediol phosphite; 2,2-methylenebis(4,6-di-t-butylphenyl) 2-ethylhexyl phosphite, trilauryl trithiophosphite, tributyl phosphate, triphenyl phosphate, tritolyl phosphate, triphenyl phosphorothionate, tris(nonylphenyl)phosphorothionate and tris (butylphenyl)phosphorothionate.

21. A method for improving the anti-fatigue, anti-wear, and extreme pressure properties of lubricants comprising adding to said lubricants (A) from 0.01 to 5 wt % of at least one hydroxy carboxylic acid ester or hydroxy polycarboxylic acid ester having the following generic formula:

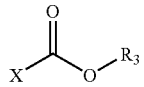

wherein: $R_3$ is selected from the group consisting of $C_1$-$C_{18}$ linear or branched alkyl, $C_1$-$C_{18}$ linear or branched alkenyl, alkoxyalkyl, hydroxyalkyl, aryl, and benzyl; and X— is selected from the group consisting of

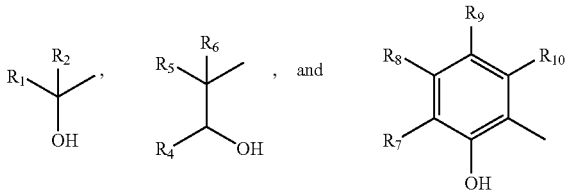

wherein:

$R_1$ is selected from the group consisting of hydrogen, $CH_2CO_2R_3$, $CH(OH)CO_2R_3$, alkyl, aryl, alkoxyalkyl, and alkaryl;

$R_2$ is selected from the group consisting of hydrogen, alkyl, and $CH_2CO_2R_3$; provided that:

if $R_1$ is $CH_2CO_2R_3$, then $R_2$ is hydrogen or $CH_2CO_2R_3$;

if $R_1$ is $CH(OH)CO_2R_3$, then $R_2$ is hydrogen;

if $R_1$ is alkyl, aryl, alkoxyalkyl, or alkaryl, then $R_2$ is hydrogen or alkyl;

$R_4$ is selected from the group consisting of hydrogen, alkyl, aryl, and $CH_2CO_2R_3$; and $R_5$ and $R_6$ are independently selected from the group consisting of hydrogen, alkyl, and aryl; and $R_7$, $R_8$, $R_9$, and $R_{10}$ are independently selected from the group consisting of hydrogen, $CO_2R_3$, alkyl, and fused aryl; and (B) from 0.01 to 2 wt % of at least one phosphorus-containing additive selected from the group consisting of dibutyl phosphite, dihexyl phosphite, dicyclohexyl phosphite, diisodecyl phosphite, di-n-octylphosphite, diphenyl isodecyl phosphite, diphenyl phosphite, di-n-octyl phosphite, dioleyl hydrogen phosphite, dimethylphenyl phosphite, ethyl hexyl diphenyl phosphite, phenyl diisodecyl phosphite, triisodecyl phosphite, triisoocytyl phosphite, trilauryl phosphite, triphenyl phosphite, tris(dipropyleneglycol)phosphite, tris(nonylphenyl)phosphite, tris(2,4-di-t-butylphenyl)phosphite, tris(5-norbornene-2-methyl)phosphite, tris(tridecyl) phosphite, bis-2,4-di-t-butylphenyl)pentaerythritol diphosphite, bis(2,6-di-t-butyl4-methylphenyl)pentaerythritol diphosphite, bis(2,4-dicumylphenyl)pentaerythritol diphosphite, diisodecyl pentaerythritol diphosphite, distearyl pentaerythritol diphosphites, heptakis(dipropyleneglycol)triphosphite, tetraphenyl dipropyleneglycol diphosphite, tetrakis(2,4-di-t-butylphenyl)-4,4'-biphenylene diphosphite, poly(dipropyleneglycol)phenyl phosphite, poly 4,4'isopropylidene-diphenol-$C_{12}$-$C_{15}$ alcohol phosphite, alkyl ($C_{10}$) bisphenol A phosphite, alkyl ($C_{12}$-$C_{15}$) bisphenol A phosphite, tris(dipropyleneglycol)phosphite, phenyl neopentylene glycol phosphite, 2,4,6-tri-t-butylphenyl-2-butyl-2-ethyl-1,3 propanediol phosphite; 2,2-methylenebis(4,6-di-t-butylphenyl) 2-ethylhexyl phosphite, trilauryl trithiophosphite, tributyl phosphate, triphenyl phosphate, tritolyl phosphate, triphenyl phosphorothionate, tris(nonylphenyl)phosphorothionate and tris(butylphenyl)phosphorothionate.

* * * * *